US006093665A

United States Patent [19]

Sayovitz et al.

[11] Patent Number: 6,093,665

[45] Date of Patent: Jul. 25, 2000

[54] PATTERN BONDED NONWOVEN FABRICS

[75] Inventors: John Joseph Sayovitz, Marietta; Angela Raye Mayfield, Atlanta; Ernest Paul Sedlock, Jr., Marietta, all of Ga.

[73] Assignee: Kimberly-Clark Worldwide, Inc., Neenah, Wis.

[21] Appl. No.: 08/129,921

[22] Filed: Sep. 30, 1993

[51] Int. Cl.[7] ..... D04H 1/54

[52] U.S. Cl. ..... 442/394; 442/401; 442/409; 428/103; 428/104; 428/156; 428/298; 604/379; 604/380

[58] Field of Search ..... 428/284, 286, 428/288, 296, 298; 604/379, 380; 442/394, 401, 409

[56] References Cited

U.S. PATENT DOCUMENTS

| | | | |
|---|---|---|---|
| D. 14,001 | 6/1883 | Conde . | |
| D. 64,020 | 2/1924 | Lord . | |
| D. 86,943 | 5/1932 | Upton . | |
| D. 87,763 | 9/1932 | Stone . | |
| D. 100,371 | 7/1936 | Grabelsky . | |
| D. 120,305 | 4/1940 | Samuelson . | |
| D. 133,342 | 8/1942 | Sokoloff . | |
| D. 134,230 | 10/1942 | Rosenstein . | |
| D. 179,793 | 2/1957 | Wright | D87/3 |
| D. 187,362 | 3/1960 | Ellefson | D87/3 |
| D. 189,902 | 3/1961 | Ellefson | D87/3 |
| D. 192,905 | 5/1962 | Kelly | D87/3 |
| D. 262,747 | 1/1982 | Erickson | D59/2 B |
| D. 301,088 | 5/1989 | Kawaguchi | D5/58 |
| D. 301,405 | 6/1989 | Kawaguchi | D5/58 |
| 885,565 | 4/1908 | Batten . | |
| 3,258,385 | 6/1966 | Lake | 156/581 |
| 3,855,046 | 12/1974 | Hansen et al. | 161/150 |
| 4,035,219 | 7/1977 | Cumbers | 156/290 |
| 4,041,203 | 8/1977 | Brock et al. | 428/157 |
| 4,103,058 | 7/1978 | Humlicek . | |
| 4,167,092 | 9/1979 | Medwed | 53/373 |
| 4,170,680 | 10/1979 | Cumbers | 428/195 |
| 4,211,227 | 7/1980 | Anderson et al. . | |
| 4,306,929 | 12/1981 | Menikheim et al. | 156/290 |
| 4,324,827 | 4/1982 | Obayashi et al. | 428/192 |
| 4,451,520 | 5/1984 | Tecl et al. | 428/198 |
| 4,473,432 | 9/1984 | Leader et al. | 156/582 |
| 4,572,753 | 2/1986 | Bach | 156/73.1 |
| 4,586,317 | 5/1986 | Bussell | 53/451 |
| 4,692,368 | 9/1987 | Taylor et al. | 428/137 |
| 4,774,124 | 9/1988 | Shimalla et al. . | |
| 4,798,639 | 1/1989 | Yamaguchi et al. | 156/73.1 |
| 4,892,535 | 1/1990 | Björnberg et al. . | |
| 5,030,302 | 7/1991 | Jud et al. | 156/164 |
| 5,069,676 | 12/1991 | Ito et al. . | |
| 5,100,491 | 3/1992 | Ijiri et al. | 156/220 |
| 5,173,143 | 12/1992 | Fujii et al. | 156/290 |
| 5,242,435 | 9/1993 | Murji et al. . | |
| 5,244,482 | 9/1993 | Hassenboehler, Jr. et al. . | |
| 5,282,920 | 2/1994 | Fujii et al. | 156/553 |
| 5,366,786 | 11/1994 | Connor et al. . | |

FOREIGN PATENT DOCUMENTS

| | | |
|---|---|---|
| 0569860A1 | 11/1993 | European Pat. Off. . |
| 079450 | 5/1958 | United Kingdom . |

*Primary Examiner*—Terrel Morris
*Attorney, Agent, or Firm*—William D. Herrick

[57] ABSTRACT

The present invention provides bond patterns for nonwoven fabrics and laminates thereof, and a process of producing the bond patterns. The bond patterns provides highly distinct and recognizable patterns without significantly reducing the physical properties of the nonwoven fabrics. The bond pattern comprises a series of unbonded regions in a geometric pattern of regularly bonded regions, and each unbonded region forms an unbonded area enclosed by the bonded regions surrounding the unbonded region, whereby the series of unbonded regions forms a visually recognizable pattern, wherein the bonded regions cover from about 3% to about 50% of the surface of the nonwoven web, and wherein each of the unbonded areas has a size equal to or less than about 0.3 $cm^2$.

17 Claims, 4 Drawing Sheets

PATTERN BONDED NONWOVEN FABRICS

BACKGROUND OF THE INVENTION

The present invention is related to pattern bonded nonwoven fabrics or webs, and the process of producing the same.

Many processes for producing bonded nonwoven fabrics are known in the art. In particular, it is known to apply heat and pressure for bonding at limited areas of a nonwoven web by passing it through the nip between heated calender rolls either or both of which may have patterns of lands and depressions on their surfaces. During such a bonding process, depending on the types of fibers making up the nonwoven web, the bonded regions may be formed autogenously, i.e., the fibers of the web are melt fused at least in the pattern areas, or with the addition of an adhesive.

It is known in the art that physical properties of bonded nonwoven fabrics are related to the degree and the pattern of bonding. In general, a large bonded area may be applied to provide dimensional stability to nonwoven fabrics, at the expense of flexibility and porosity, and geometrically repeating bond patterns are employed to provide isotropic dimensional stability. However, different property requirements for different uses may dictate the use of random or irregular patterns.

It is also known in the art that repeating bond patterns may be altered to produce aesthetically improved nonwoven fabrics. Such attempts are disclosed, for example, in U.S. Pat. Nos. 3,542,634 to J. Such et al.; 4,170,680 to Cumbers and 4,451,520 to Tecl et al. However, these patents do not recognize that properly arranged bond patterns may provide other useful utilities than aesthetical effects.

SUMMARY OF THE INVENTION

There is provided in accordance with the present invention a distinctly identifiable bond pattern for nonwoven webs having a geometrically repeating pattern of bonded regions. The bond pattern comprises a series of unbonded region in the geometric pattern of bonded regions, and each unbonded regions forms an unbonded area which is enclosed by the bonded region surrounding the unbonded regions, whereby the series of unbonded regions forms a visually recognizable pattern. The bonded regions cover from about 3% to about 50% of the surface of the nonwoven web, and the size of each of the unbonded areas is equal to or less than about 0.3 $cm^2$. Further provided herein is a nonwoven fabric having the present bond pattern.

Additionally provided herein is a bonding process for producing the nonwoven fabric containing a distinctly identifiable bond pattern. The process comprises the step of feeding at least one layer of nonwoven web into the nip formed by a set of abuttingly placed patterning rolls, in which at least one of the patterning rolls has a geometrically repeating bond pattern of lands that is modified by a series of absent land. Each of the absent land forms a nonbonding area defined by the lands surrounding the absent land, and the nonbonding area has a size equal to or less than about 0.3 $cm^2$. The series of absent lands forms a visually recognizable pattern, and the remaining lands occupy from about 3% to about 50% of the surface of the patterning roll.

The bond patterns of the present invention are easily recognizable and are highly useful as identification marks to denote various information, e.g., sources of origin, characteristics and properties of and designated uses, for each fabric without significantly sacrificing desired properties such as dimensional stability, web strength, barrier and abrasion resistance of the fabric.

DETAILED DESCRIPTION OF THE INVENTION

Figure 1:
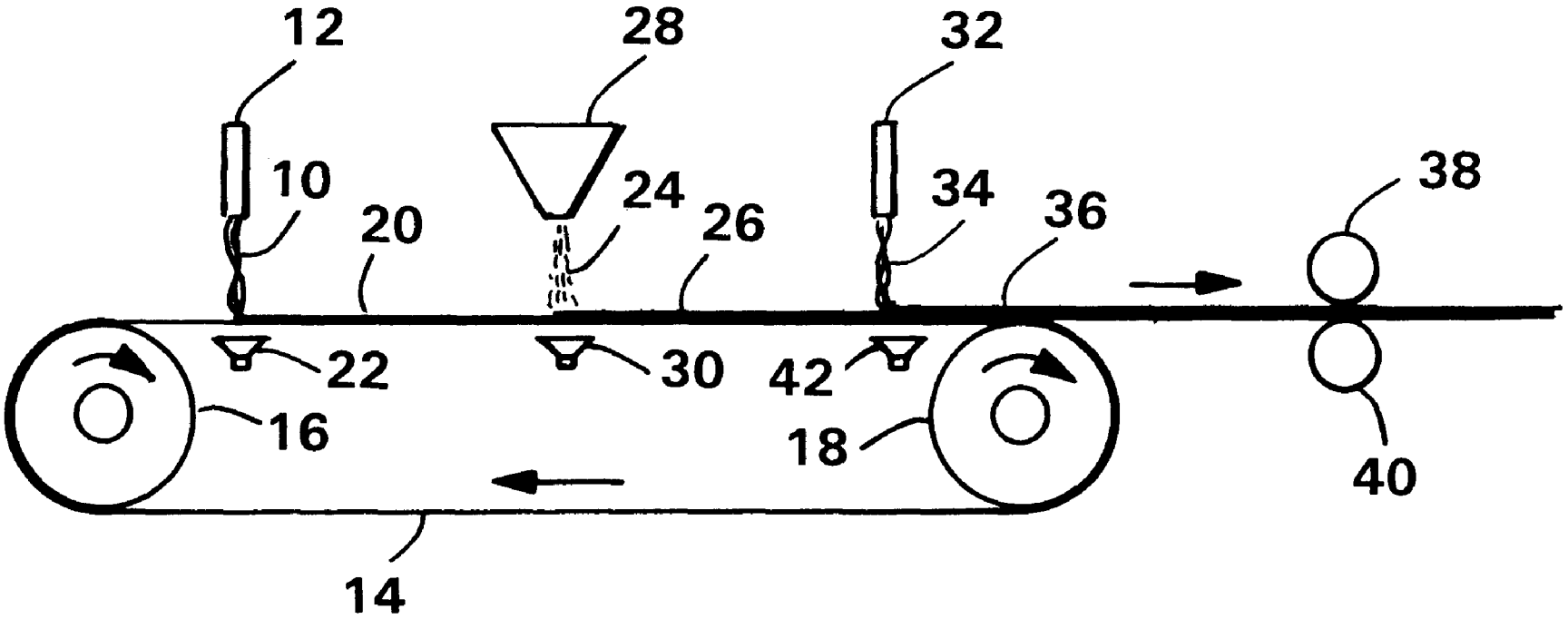
FIG. 1 is a schematic diagram of a nonwoven fabric forming machine which is used in making the pattern bonded nonwoven fabric of the present invention.

The present invention provides nonwoven fabrics having one or more of visually recognizable and discernible bond patterns. The bond pattern is highly suited as an identification mechanism for nonwoven fabrics without significantly sacrificing useful properties of the fabrics, such as surface abrasion resistance, web strength and dimensional stability. Accordingly, the present bond pattern is highly suited as identification marks to denote various sources of origin, characteristics and properties of nonwoven fabrics, e.g., weight, composition, hydrophobicity, hydrophilicity and the like, and to denote designated uses for each fabric, e.g., medical applications, environmental uses, and the like. In addition, the bond patterns are highly suited as alignment or demarcation points to assist manufacturing processes in which articles, such as garments, diapers, protective clothings and the like, from such nonwoven fabrics are assembled or produced.

The present distinctly identifiable bond pattern is highly useful for nonwoven fabrics having geometrically repeating base bond patterns. The size, shape, arrangement and pattern of bonded regions for the useful base bond patterns may vary widely as long as the patterns created by the bonded regions are regular and repeating. Depending on required aesthetical effects and physical properties for different uses of the nonwoven fabrics, the size and/or shape of each bonded region as well as the distance between adjacent bonded regions in a repeating bond pattern may vary, also. As mentioned above, the area and size of bonded regions impart different properties to the nonwoven fabrics. For example, large bonded regions tend to impart dimensional stability, while small bonded regions provide flexibility, drapability and porosity. Of the various useful base bond patterns, particularly useful patterns are evenly spaced repeating bond patterns having bonded regions of uniform shape and size.

The present bond pattern may be characterized as a series of missing bonded regions (unbonded regions) in a geometrically repeating base pattern of bonded regions, whereby the series of unbonded regions forms a visually distinct pattern within the geometrically repeating base pattern of bonded regions. The surface area of the nonwoven fabrics of the present invention is covered by from about 3% to about 50%, preferably about 4% to about 45%, more preferably about 5 to about 35% , bonded regions. The bonded region density of the nonwoven fabric is preferably from about 8 to about 120 regions per square centimeter ($cm^2$), more preferably from about 12 to about 64 regions per $cm^2$.

In accordance with the present invention, each of the unbonded areas enclosed by the bonded regions is preferably equal to or less than about 0.3 $cm^2$, more preferably equal to or less than about 0.25 $cm^2$, and most preferably equal to or less than about 0.12 $cm^2$. Although the placement of the unbonded regions can vary to accommodate different needs and uses, in order to take full advantage of the present invention, it is desirable to have the unbonded regions not concentrated in one section of the fabric, but intermittently dispersed throughout since having the unbonded regions concentrated in one section adversely affects desriable properties such as abrasion resistance, web strength, barrier characteristics and dimentional stability of that section. Accordingly, it is preferred that the total size of the unbonded areas in any 4 $cm^2$ square on the surface of the present invention fabric is equal to or less than about 0.6 $cm^2$, more preferably equal to or less than about 0.5 $cm^2$. Additionally, in applications where abrasion resistance, barrier properties and dimensional stability are required, the size of the bonded area, i.e., the area enclosed by bonded regions, between adjacent unbonded areas should be equal to or greater than about 50% of the size average of the unbonded areas. Additionally, in such applications, it is preferred that the total number of unbonded regions is equal to or less than 10% of the total number of bonded regions of the base pattern in order to ensure that the desired physical properties of the fabrics bonded with the present bond pattern do not significantly change from those of the fabrics having the base bond pattern.

Nonwoven webs suitable for producing the present nonwoven fabrics are any known nonwoven webs that are amenable to pattern bonding, which include, but are not limited to, fiber webs fabricated from staple fibers, continuous fibers or mixtures thereof, and the fibers may be natural, synthetic or mixtures thereof. In addition, suitable fibers may be crimped or uncrimped, and synthetic fibers may be monocomponent fibers or multicomponent conjugate fibers, e.g., bicomponent side-by-side or sheath-core fibers.

Illustrative of suitable natural fibers include cellulosic fibers, cotton, jute, pulp, wool and the like. When natural fiber webs are utilized, a binder or an adhesive, in the form of fibers or powders, may be sprayed on or mixed with the fibers of the web to consolidate the constituent fibers or otherwise applied to form bonded regions. Illustrative of suitable binders include ethylene vinylacetate, acrylate adhesives, acrylic adhesives, latex and the like.

Synthetic fibers suitable for the present invention are produced from synthetic thermoplastic polymers that are known to form fibers, which include, but are not limited to, polyolefins, e.g., polyethylene, polypropylene, polybutylene and the like; polyamides, e.g., nylon 6, nylon 6/6, nylon 10, nylon 12 and the like; polyesters, e.g., polyethylene terephthalate, polybutylene terephthalate and the like; polycarbonate; polystyrene; thermoplastic elastomers; vinyl polymers; polyurethane; and blends and copolymers thereof. Additionally suitable fibers include glass fibers, carbon fibers, semi-synthetic fibers, e.g., viscose rayon fibers and cellulose acetate fibers, and the like. In accordance with known properties of each polymer, synthetic and semi-synthetic polymer fibers can be bonded autogenously, i.e., the fibers of the web are melt-fused under heat and pressure, or with the use of a binder. For example, fiber webs of polyolefins, polyamides, polyesters, vinyl polymers or the like can be autogenously bonded, and webs of glass fibers and/or carbon fibers require the use of a binder.

Suitable staple fiber webs may be prepared by carding a mass of staple fibers with a woollen or cotton carding machine or a garnetting machine, and suitable continuous fiber webs may be prepared by conventional air laying methods that produce webs from meltblown fibers and/or spunbond fibers. As used herein, the term "meltblown fibers" indicates fibers formed by extruding a molten thermoplastic polymer through a plurality of fine, usually circular, die capillaries as molten threads or filaments into a high velocity gas stream which attenuates the filaments of molten thermoplastic polymer to reduce their diameter. In general, meltblown fibers have an average fiber diameter of up to about 10 microns. After the fibers are formed, they are carried by the high velocity gas stream and are deposited on a collecting surface to form a web of randomly dispersed meltblown fibers. Such a process is disclosed, for example, in U.S. Pat. No. 3,849,241 to Butin. As used herein, the term "spunbond fibers" refers to small diameter fibers which are formed by extruding a molten thermoplastic polymer as filaments from a plurality of fine, usually circular, capillaries of a spinneret. The extruded filaments are then rapidly drawn by an eductive or other well-known drawing mechanism. The resulting fibers, in general, have an average diameter larger than that of meltblown fibers. Typically, spunbond fibers have an average diameter in excess of 12 microns and up to about 55 microns. The production of spunbond webs is disclosed, for example, in U.S. Pat. Nos. 4,340,563 to Appel et al. and 3,692,618 to Dorschner et al.

The fabrics of the present invention further include laminates of two or more of the above-mentioned nonwoven webs and laminates of nonwoven webs and films. Various films known in the art, particularly thermoplastic films, can be bonded to the nonwoven webs, autogenously or with the use of a binder, to provide added barrier properties, such as moisture, chemical and aroma barrier properties. Useful thermoplastic films can be produced from, for example, polyolefins, e.g., polyethylene, polypropylene, polybutylene and the like; polyamides, e.g., nylon 6, nylon 6/6, nylon 10, nylon 12 and the like; polyesters, e.g., polyethylene terephthalate, polybutylene terephthalate and the like; polycarbonate; polystyrene; thermoplastic elastomers; vinyl polymers; polyurethane; and blends and copolymers thereof.

The present invention can be practiced employing any pattern bond forming process known in the art. Preferably, the bond pattern is applied using a conventional calender bonding process. In general, the calender bonding process employs pattern roll pairs for bonding at limited areas of the web by passing it through the nip between the rolls while at least one of which is heated and has a pattern of lands and depressions on its surface. Alternatively, the bond pattern can be applied by passing the web through a gap formed by an ultrasonic work horn and anvil. The anvil may be in the form of a roll having raised portions to provide a pattern bonded fabric.

The temperature of the pattern rolls and the nip pressure should be selected so as to effect bonding without having undesirable accompanying side effects such as excessive shrinkage or web degradation. Although appropriate roll temperatures and nip pressures are generally influenced to an extent by parameters such as web speed, web basis weight, fiber characteristics, presence or absence of adhesives and the like, it is preferred that the roll temperature be in the range between softening and crystalline melting temperatures of the component fiber polymer in combination with nip pressures on raised points (pin pressure) of about 1,000 to about 50,000 psi. It may not be desirable to expose the web to a temperature where extensive fiber melting occurs. For example, the preferred pattern bonding settings for polypropylene webs are a roll temperature in the range of about 260° F. and 320° F., and a pin pressure in the range of about 1,000 psi and about 10,000 psi. However, when adhesives other than melt-adhesives are utilized to consolidate and to form the present bond pattern, no significant heat and pressure need to be applied since only a minimal pin pressure is needed to hold the fibers in place until the adhesives cure to form permanent bonds.

Suitable pattern rolls for the present invention may be produced from well known materials, such as steels for patterned rolls and high temperature rubbers for smooth rolls, and according to processes well known in the art. The pattern rolls of the present invention can be conveniently produced by removing appropriate lands from finished pattern rolls that contain geometrically repeating base bond patterns. Alternatively, the pattern rolls may be produced from a mold containing desired patterns. Suitable pattern roll forming procedures are well known in the engraving art. The bond patterns of the present invention, as an alternative to the above-described in-line roll patterning process, can also be formed by stamping processes known in the art, using male and female molds.

As an illustration of the present invention, FIG. 1 represents one manner of preparing a three layer laminate of two outer spunbond webs and a middle meltblown web, which is bonded in accordance with the present bond pattern process. As shown, a curtain of continuous spunbond filaments 10 is prepared by a spinneret assembly 12. The filaments are deposited in a substantially random manner onto a moving foraminous carrier belt 14 driven over a set of drive rolls 16, 18 to form a spunbond web 20. Onto the spunbond web 20, a layer of meltblown fibers 24 is deposited to form a two layer laminate 26. The meltblown fibers 24 are prepared with a meltblown fiber spinneret assembly 28. The two layer laminate 26 continues to travel on the carrier belt 14 to reach an additional spunbond spinneret assembly 32 where the other outer layer 34 of spunbond fibers is deposited onto the laminate, forming the three layer laminate 36. Appropriate suction means 22, 30 and 42 may be presented under the carrier belt 14 away from the spinneret assemblies to assist proper placement of each fiber layer. Subsequently, the three layer laminate 36 is passed through the pressure nip between a heated roll 38 and another heated roll 40 which contains a pattern of lands and depressions. The two heated rolls 38, 40 are commonly referred to as patterning or embossing rolls. The bonded, patterned laminate is then removed from the heated rolls 38, 40.

Although FIG. 1 discloses the process of bonding a laminate of three nonwoven webs, the present invention is not limited thereto. The present bond pattern can be utilized for one or more layers of nonwoven webs and for laminates of nonwoven webs and films. In addition, both of the heated rolls 38, 40 may have repeating bond patterns, and more than one set of patterning rolls can be employed.

Figure 2:
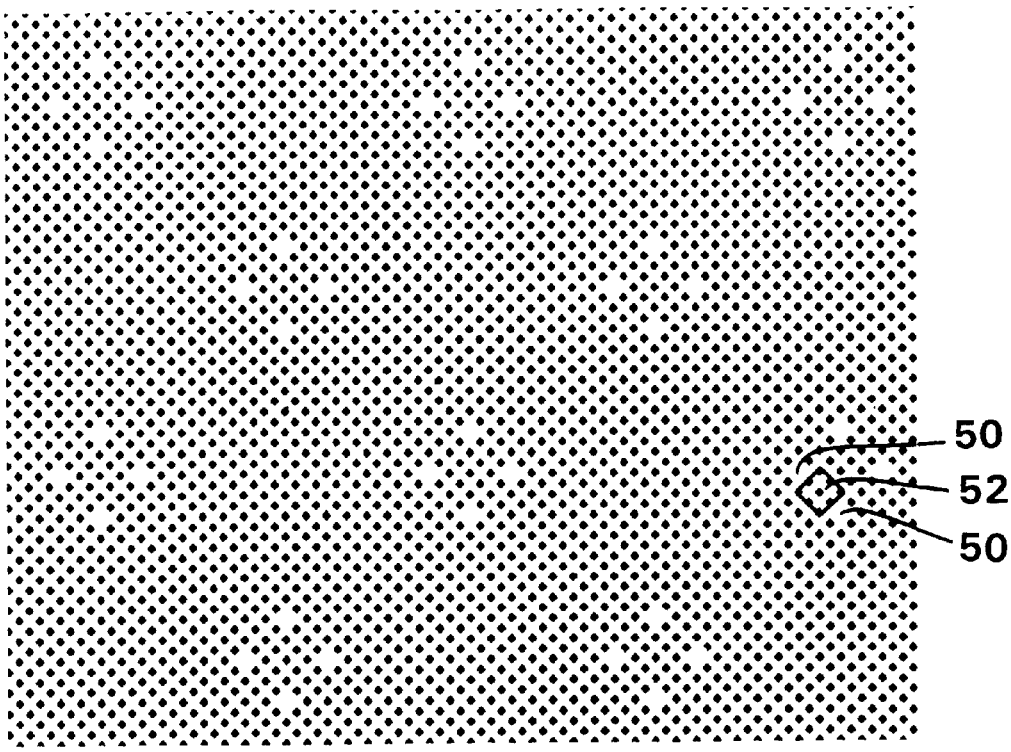
FIGS. 2–6 are illustrative bond patterns of the present invention.
Figure 3:
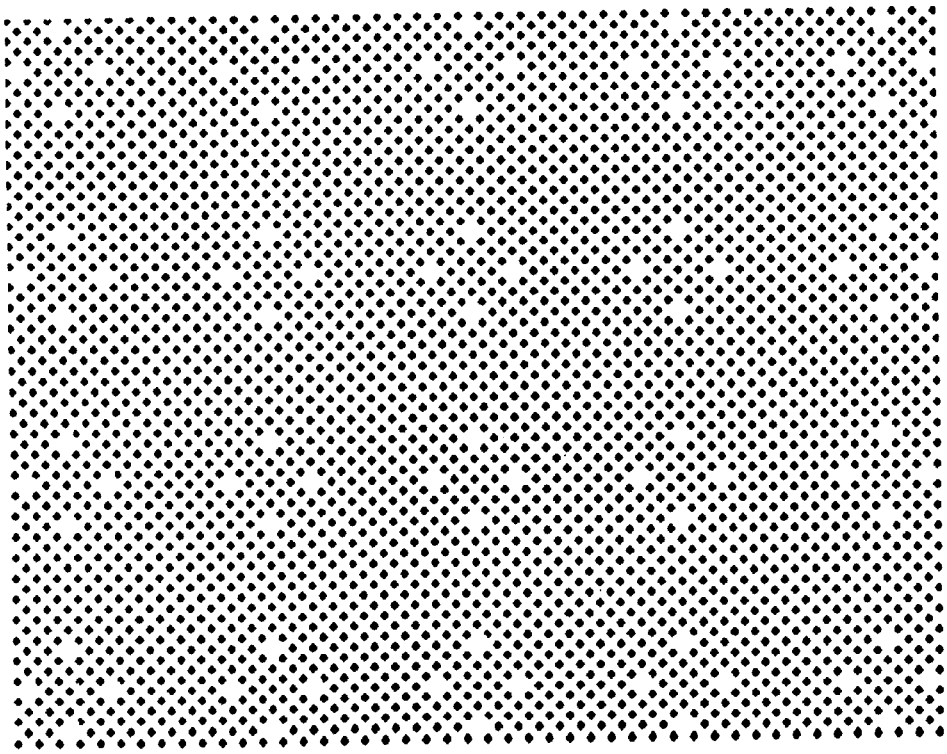
Figure 4:
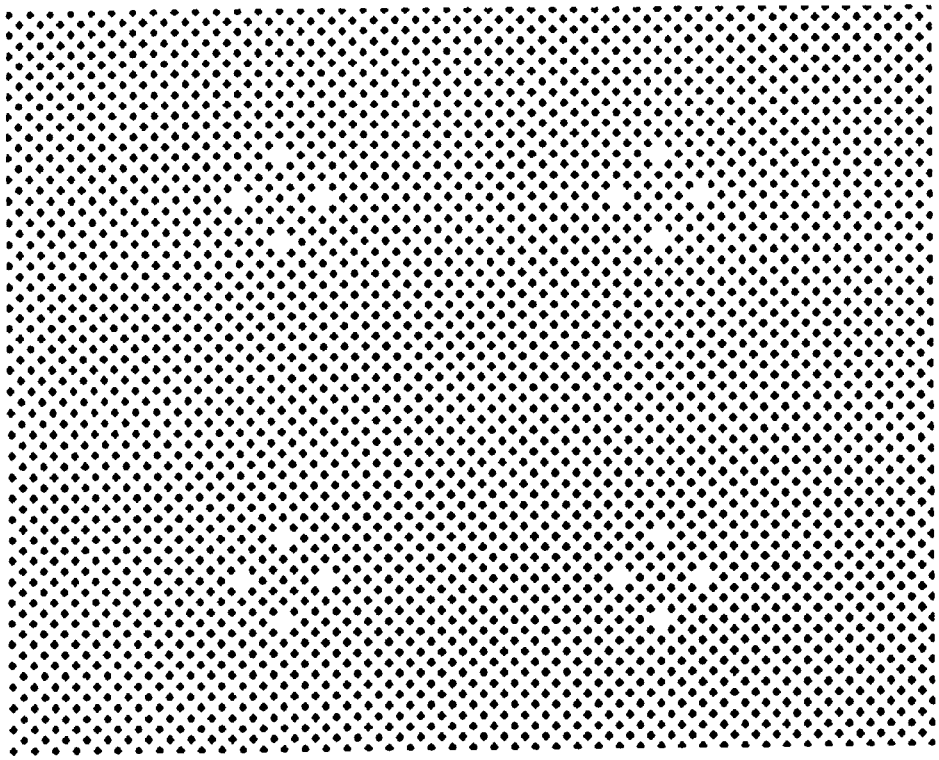
Figure 5:
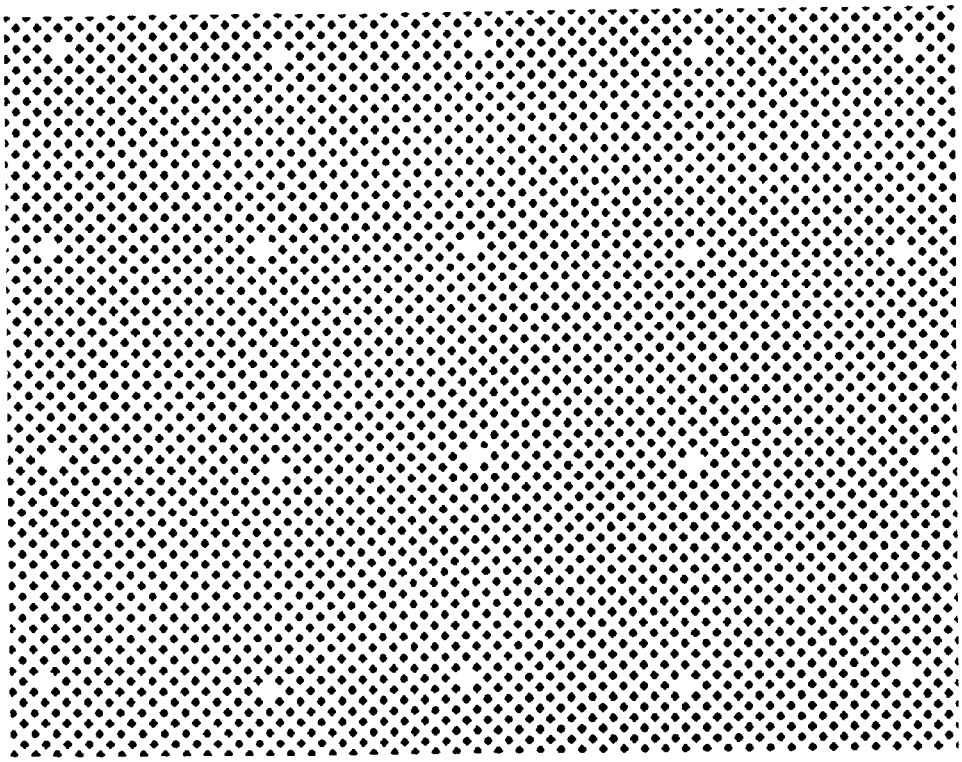
Figure 6:
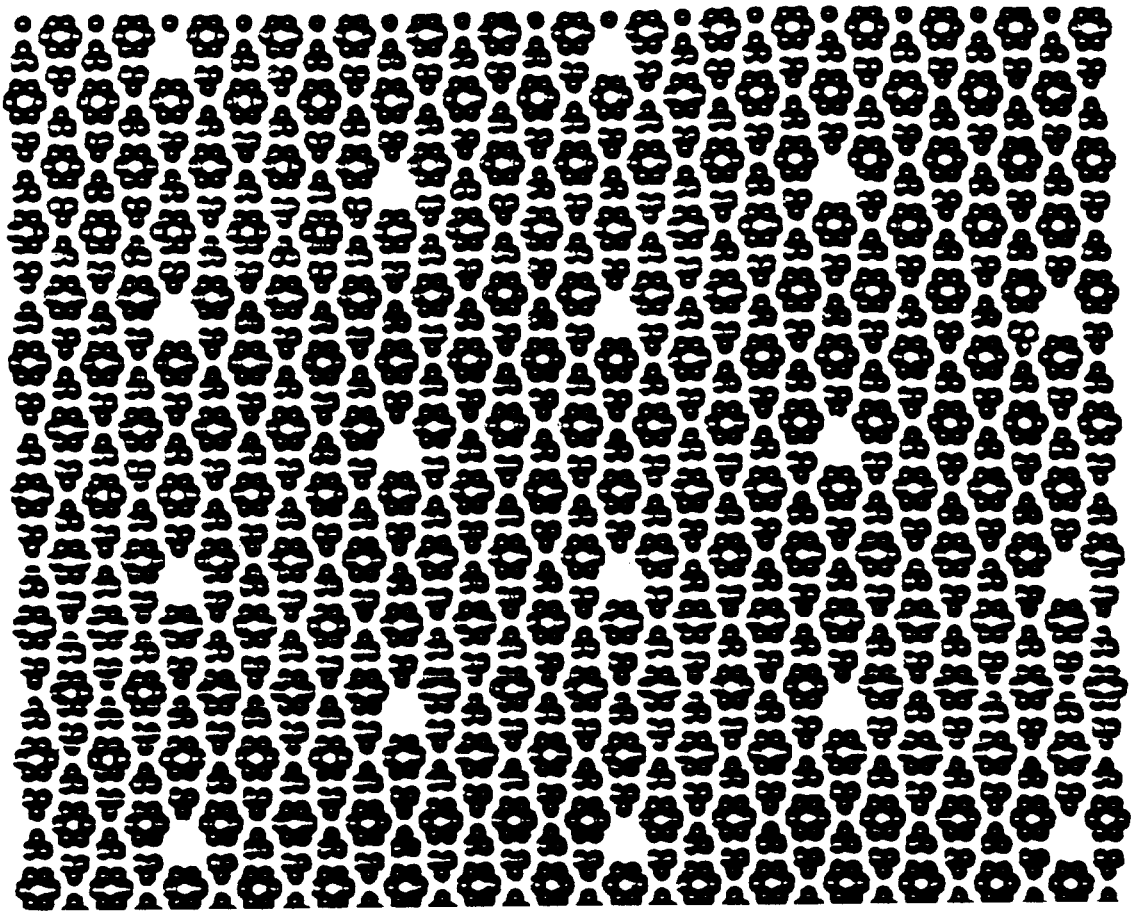

FIGS. 2–5 provide non-limiting examples of bond patterns that can be created in accordance with the present invention. In FIG. 2, for example, four closely associated unbonded areas 50 form a small diamond pattern and four of the small diamond pattern form a large diamond pattern, providing a highly distinct and readily recognizable pattern to the nonwoven fabric. Adjacent unbonded areas 50 forming the small diamond pattern are separated by a bonded area 52 to ensure physical integrity of the resulting fabric. FIGS. 3 and 4 illustrate different sizes of square patterns that are formed by the above-mentioned small diamond pattern. FIG. 5 illustrates a distinct square pattern formed by equally spaced unbonded areas. FIG. 6 illustrates yet another bond pattern of the present invention which is based on a different base bond pattern than the base pattern of FIGS. 2–5. The present bond patterns provide distinctly identifiable marks that can be easily applied and changed to create many different, useful bond patterns without significantly altering the physical properties of the resulting nonwoven fabric. In addition, the bond patterns are highly useful as aligning or size reference points for different processes using the nonwoven fabrics. Such aligning or size reference points are useful, for example, in cutting operations where nonwoven fabric parts for nonwoven fabric gowns, disposable diapers or the like are prepared.

Although the present bond pattern is illustrated with nonwoven fabrics and laminates thereof, the present bond pattern can also be useful for various films and laminates thereof to provide the above-mentioned utilities of the present invention.

The invention is described further with reference to the following examples, which are provided for illustration purposes and are not intended to limit the present invention thereto.

EXAMPLES 1–4

Four three-layer polypropylene nonwoven fabrics having different bond patterns as illustrated in FIGS. 2–5, which are Examples 1–4 respectively, were prepared and physical characteristics of the fabrics were compared. The fabrics were prepared in a process as shown in FIG. 1: an external spunbond layer is formed onto the carrier belt; a middle layer of meltblown fiber is deposited onto the external spunbond layer; and the other external spunbond layer is formed on the meltblown layer. The weight of the spunbond layers was about 0.85 oz/yd$^2$ and of the meltblown layer was about 0.5 oz/yd$^2$. Subsequently, the resulting three-layer nonwoven laminate was fed into the nip of a calender roll and an anvil roll. The calender roll was a steel roll having a patterned configuration of raised points (lands) on its surface and a diameter of about 24 inches (61 cm). The calender roll was equipped with a heating means and the raised points (lands) thereon were about 0.04 inch (0.1 cm) high and positioned such that the resulting bonded fabric contained regularly spaced bonded areas in a square pattern. The anvil roll was a smooth stainless steel 24 inch diameter roll with a heating means. Both of the rolls were heated at about 305° F. (152° C.) and the pressure applied on the webs was 500 lbs/linear inch of width. The calender rolls used in Examples 1–4 were prepared by removing appropriate lands from the above-described calender rolls having regularly spaced lands and had a pin density of about 34 lands per cm$^2$ and each of the lands had a bonding area of about 0.0074 cm$^2$. The size of each of the resulting unbonded areas was about 0.07 cm$^2$. Abrasion resistance was tested in accordance with the ASTM D4970-89 testing procedure, which measures the resistance to abrasion of nonwoven fabrics. Drape stiffness was tested in accordance with Method 5206 of Federal Test Methods Standard No. 191A, which measures the resistance to bending of a fabric. Elongation, grab tensile strength (GT) and peak load energy (PKLE) were tested in accordance with Method 5100 of Federal Test Methods Standard No. 191A. Each test other than abrasion resistance was conducted in both machine direction (MD) and cross-machine direction (CD). The results are shown in the Table below.

Control

A bonded fabric was produced by following the procedure outlined for Example 1, except an unmodified base calender roll described in Example 1 was used.

TABLE

| Example | Abrasion | Drape Stiffness (in.) | | Elongation (%) | | GT (lb.) | | PKLE (in-lbs) | |
|---|---|---|---|---|---|---|---|---|---|
| | | CD | MD | CD | MD | CD | MD | CD | MD |
| 1 | 5 | 5.9 | 6.9 | 57.5 | 46.7 | 33.5 | 43.8 | 34.3 | 37.6 |
| 2 | 5 | 5.6 | 5.8 | 65.2 | 53.3 | 35.8 | 48.1 | 41.9 | 47.0 |
| 3 | 5 | 5.8 | 6.7 | 61.6 | 52.9 | 36.1 | 47.5 | 40.0 | 46.7 |
| 4 | 5 | 5.7 | 6.6 | 55.2 | 47.8 | 34.1 | 44.7 | 33.7 | 39.5 |
| Control | 5 | 5.5 | 6.2 | 56.1 | 50.9 | 35.8 | 45.9 | 35.7 | 43.2 |

As can be seen from the above examples and FIGS. 2–5, the bond pattern of the present invention does not significantly degrade the physical properties of the nonwoven fabric while providing visually identifiable bond patterns. Consequently, the bond patterns of the present invention are highly useful as identification marks to denote various information, such as sources of origin, characteristics and properties of and designated uses for nonwoven fabrics, without significantly altering the physical properties of the nonwoven fabrics.

What is claimed is:

1. A pattern bonded nonwoven fabric having at least one distinctly and visually identifiable pattern of unbonded areas, said fabric having a geometrically repeating and visually discernable base pattern of bonded regions, said identifiable pattern comprising a series of unbonded regions in said geometric pattern of bonded regions, each unbonded region forming an unbonded area which is enclosed by said bonded regions surrounding said unbonded region, wherein said series of unbonded areas forms said identifiable pattern, wherein said bonded regions cover from about 3% to about 50% of the surface of said nonwoven fabric, wherein the size of each of said unbonded areas is equal to or less than about 0.3 $cm^2$, and wherein said nonwoven fabric comprises a nonwoven fiber web.

2. The nonwoven fabric of claim 1 wherein said fiber web is formed from thermoplastic fibers, natural fibers or mixtures thereof.

3. The nonwoven fabric of claim 1 wherein said fabric is a laminate of at least one nonwoven fiber web and at least one film.

4. The nonwoven fabric of claim 1 wherein the area enclosed by the bonded regions between adjacent unbonded areas is equal to or greater than about 50% of the size average of said unbonded areas.

5. The nonwoven fabric of claim 1 wherein said nonwoven web comprises polyolefin fibers.

6. The nonwoven fabric of claim 1 wherein said bond pattern covers from about 5% to about 35% of the surface of said nonwoven fabric.

7. The nonwoven fabric of claim 1 wherein said nonwoven fiber web is selected from spunbond nonwoven webs and staple fiber nonwoven webs.

8. The nonwoven fabric of claim 7 wherein said nonwoven fabric further comprises a meltblown nonwoven web.

9. The nonwoven fabric of claim 5 wherein said polyolefin is polypropylene.

10. The nonwoven fabric of claim 5 wherein said polyolefin is polyethylene.

11. The nonwoven fabric of claim 1 wherein said nonwoven fiber web comprises conjugate fibers.

12. The nonwoven fabric of claim 1 wherein said fabric comprises a first spunbond web, a meltblown web and a second spunbond web.

13. The nonwoven fabric of claim 12 wherein said webs comprise thermoplastic fibers.

14. The nonwoven fabric of claim 13 wherein said thermoplastic fibers comprise polyolefin.

15. The nonwoven fabric of claim 14 wherein said thermoplastic fibers comprise polypropylene.

16. The nonwoven fabric of claim 14 wherein said thermoplastic fibers comprise polyethylene.

17. The nonwoven fabric of claim 1 wherein the total number of unbonded regions is equal to or less than 10% of the total number of bonded regions of said base pattern of bonded regions.

* * * * *